US010137581B2

(12) United States Patent
Werner

(10) Patent No.: US 10,137,581 B2
(45) Date of Patent: Nov. 27, 2018

(54) DRIVE FOR A HAIR CUTTING APPARATUS

(71) Applicant: ANDIS COMPANY, Sturtevant, WI (US)

(72) Inventor: Edwin A. Werner, Union Grove, WI (US)

(73) Assignee: Andis Company, Sturtevant, WI (US)

( * ) Notice: Subject to any disclaimer, the term of this patent is extended or adjusted under 35 U.S.C. 154(b) by 0 days.

(21) Appl. No.: 15/346,606

(22) Filed: Nov. 8, 2016

(65) Prior Publication Data

US 2018/0126570 A1 May 10, 2018

(51) Int. Cl.

| | |
|---|---|
| ***B26B 19/28*** | (2006.01) |
| ***B26B 19/04*** | (2006.01) |
| ***B26B 19/06*** | (2006.01) |
| ***B26B 19/38*** | (2006.01) |

(52) U.S. Cl.

CPC ..... *B26B 19/28* (2013.01); *B26B 19/04* (2013.01); *B26B 19/06* (2013.01); *B26B 19/3846* (2013.01)

(58) Field of Classification Search

CPC ..... B26B 19/04; B26B 19/06; B26B 19/28
See application file for complete search history.

(56) References Cited

U.S. PATENT DOCUMENTS 1,997,096 A * 4/1935 Mathew ..... B26B 19/063 30/199
3,136,058 A * 6/1964 Andis ..... B26B 19/282 30/210
4,219,930 A 9/1980 Franko et al.
4,700,476 A * 10/1987 Locke ..... B26B 19/06 30/220
5,088,200 A * 2/1992 Piwaron ..... B26B 19/06 30/216
5,325,590 A * 7/1994 Andis ..... B26B 19/28 30/216
5,606,799 A * 3/1997 Melton ..... B26B 19/063 30/199
7,346,990 B2 * 3/2008 Dirks ..... B26B 19/06 30/210
8,769,824 B2 * 7/2014 Heerlein ..... B26B 19/28 30/216
9,770,836 B2 * 9/2017 Werner ..... B26B 19/06
2006/0042093 A1 3/2006 Dirks et al.
2008/0263871 A1 * 10/2008 Liao ..... B26B 19/06 30/201

(Continued)

OTHER PUBLICATIONS

PCT/US2017/060600 International Search Report and Written Opinion of the International Searching Authority dated Jan. 22, 2018 (13 pages).

*Primary Examiner* — Hwei C Payer
(74) *Attorney, Agent, or Firm* — Michael Best & Friedrich LLP

(57) ABSTRACT

A drive assembly for a hair grooming device includes a yoke assembly and a support assembly. The yoke assembly includes a slot that is configured to receive an eccentric drive, and a biased tension arm having a finger at one end, the tension arm configured to engage a blade assembly. The support assembly is coupled to the yoke assembly, the support assembly includes a first arm spaced apart from a second arm, the first and second arms being respectively coupled to the yoke assembly, the yoke assembly being positioned between the first and second arms.

15 Claims, 17 Drawing Sheets

(56) References Cited

U.S. PATENT DOCUMENTS

| | | | | |
|---|---|---|---|---|
| 2014/0020253 | A1 | 1/2014 | Gilbert | |
| 2016/0075039 | A1 | 3/2016 | Werner | |
| 2018/0126570 | A1* | 5/2018 | Werner | B26B 19/04 |

* cited by examiner

DRIVE FOR A HAIR CUTTING APPARATUS

FIELD

The present invention relates to a drive for a hair cutting apparatus formed of a unitary structure that applies tension on a blade assembly, transfers rotational motion into side-to-side straight line motion, and has improved wear characteristics.

SUMMARY

In one embodiment, the invention provides a drive assembly for a hair grooming device that includes a yoke assembly and a support assembly. The yoke assembly includes a slot that is configured to receive an eccentric drive, and a biased tension arm having a finger at one end, the tension arm configured to engage a blade assembly. The support assembly is coupled to the yoke assembly, the support assembly includes a first arm spaced apart from a second arm, the first and second arms being respectively coupled to the yoke assembly, the yoke assembly being positioned between the first and second arms.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

For ease of discussion and understanding, the following detailed description will refer to and illustrate the drive assembly innovation in association with a "hair trimmer." It should be appreciated that a "hair trimmer" is provided for purposes of illustration of the drive assembly innovation disclosed herein. The drive assembly is not limited for use with a hair trimmer, and can be used in association with any hair cutting apparatus, including, but not limited to, a hair trimmer, a hair clipper, or any other suitable hair grooming device. In addition, a hair grooming device can be suitable for a human, animal, or any other suitable living, nonliving, or other object having hair.

Figure 1:
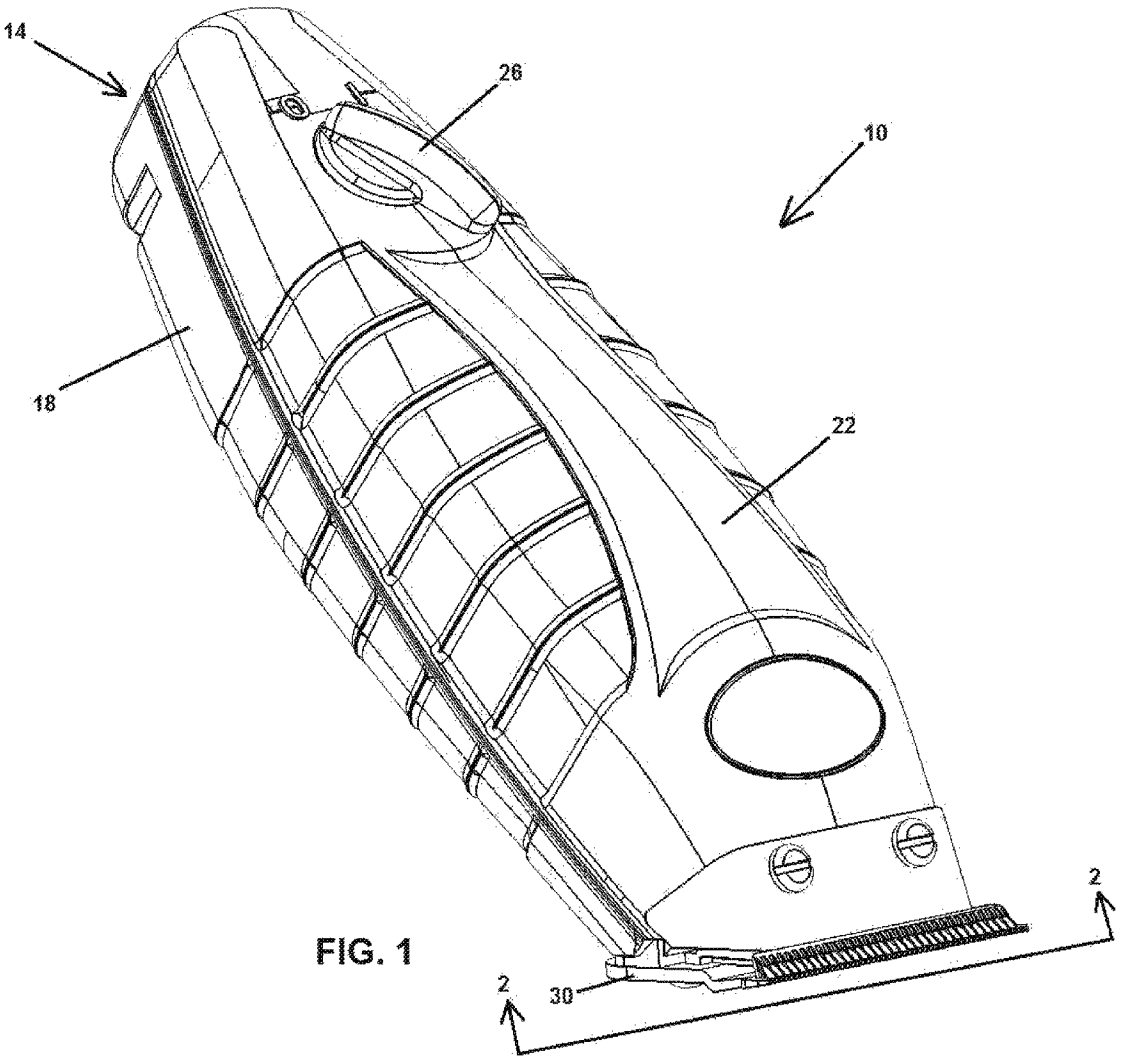
FIG. 1 is a perspective view of a hair cutting apparatus embodying the invention.
Figure 2:
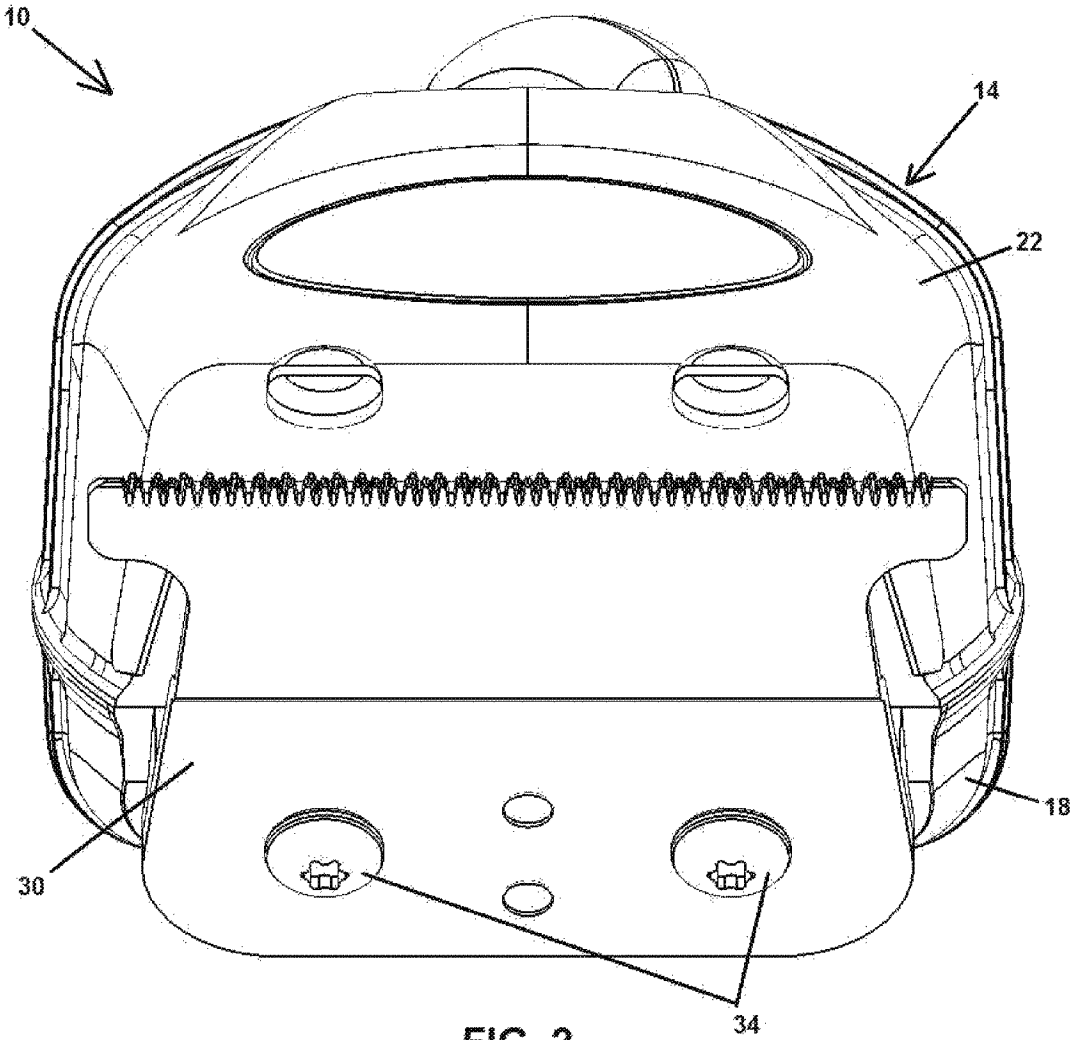
FIG. 2 is a perspective view of the hair cutting apparatus of FIG. 1, taken along line 2-2 of FIG. 1.
Figure 3:
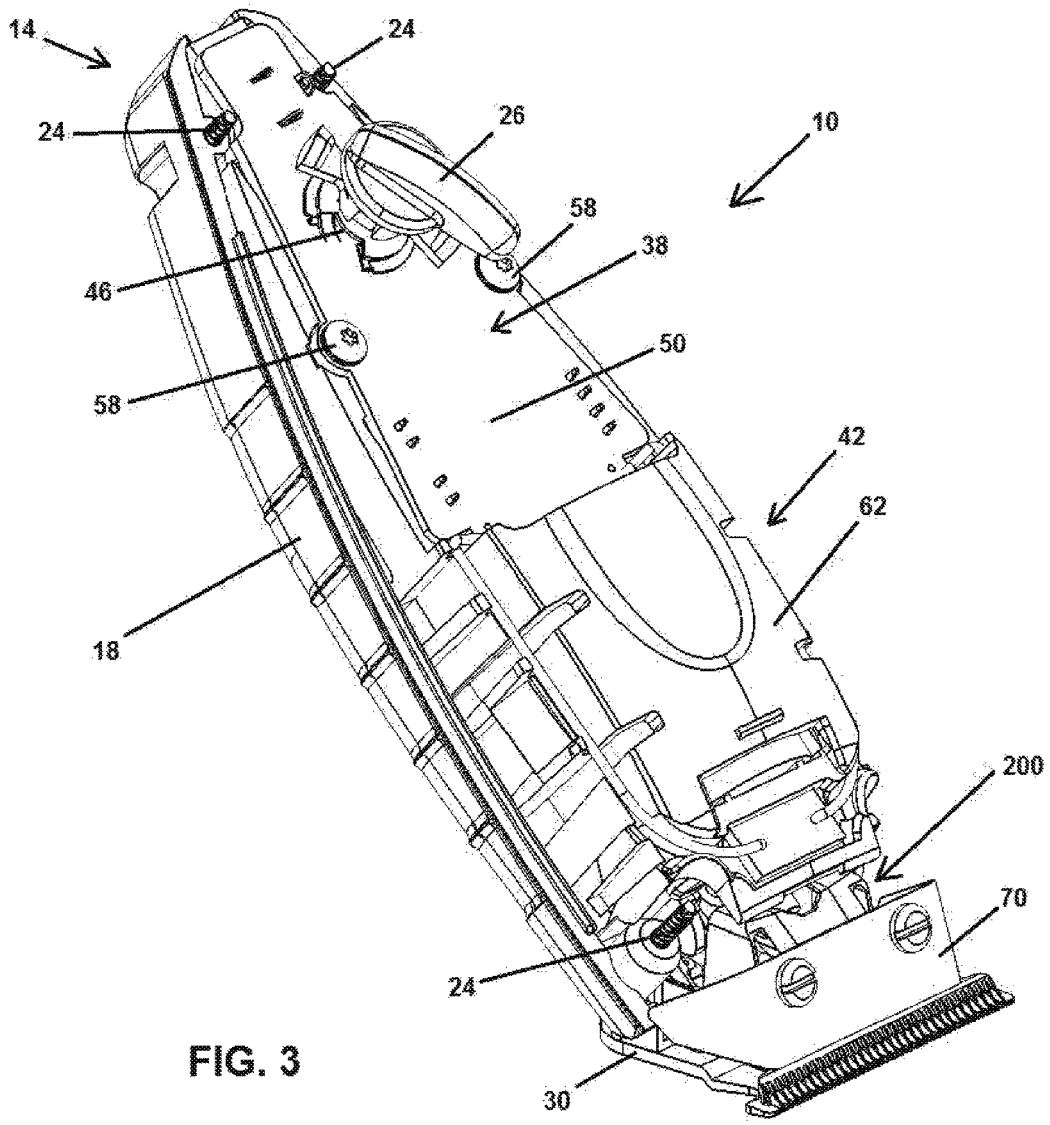
FIG. 3 is a perspective view of the hair cutting apparatus of FIG. 1 with an upper housing removed to illustrate internal components, including a power assembly and a motor assembly.
Figure 4:
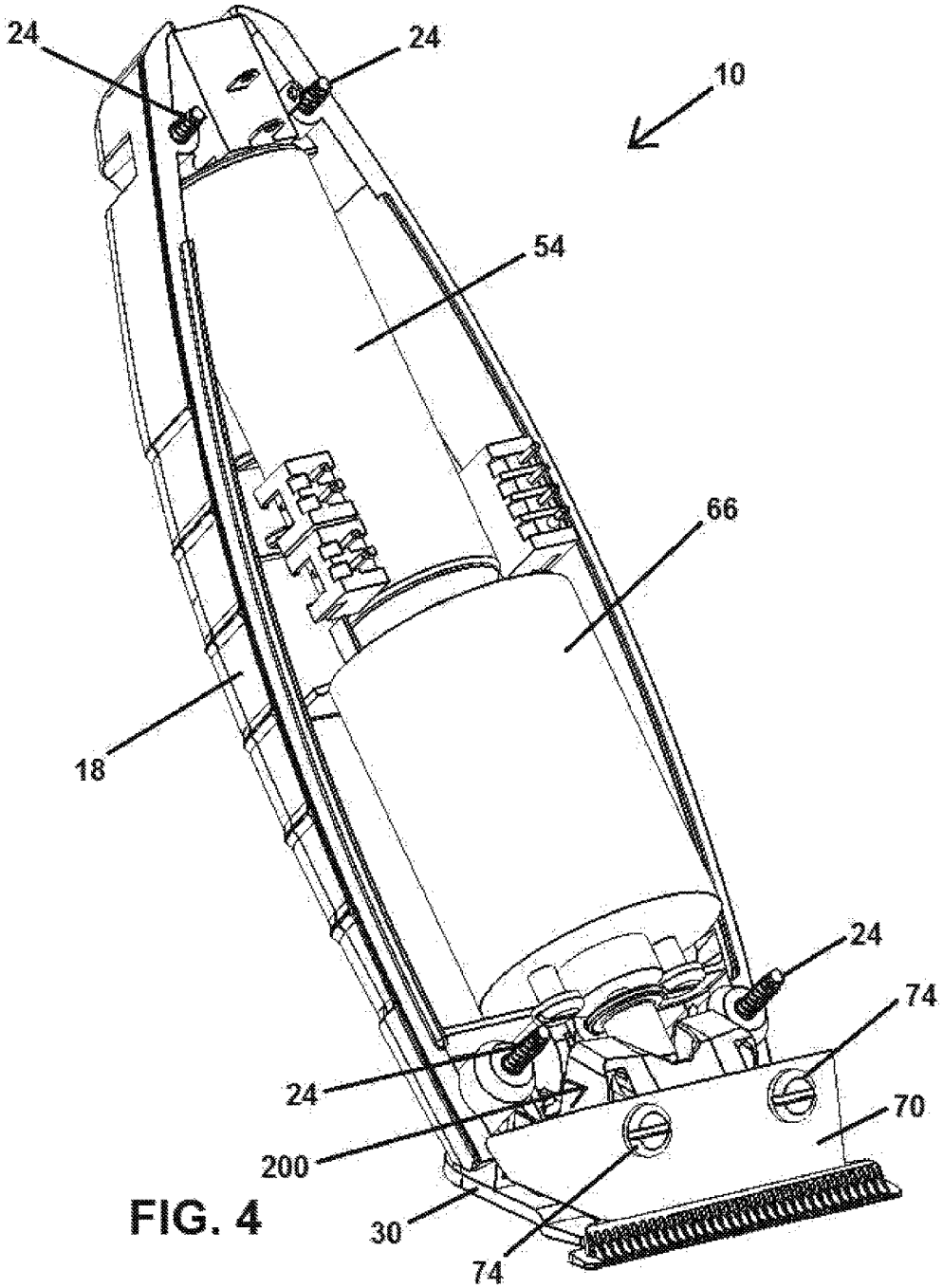
FIG. 4 is a perspective view of the hair cutting apparatus of FIG. 3 with a controller, a power switch, and a motor cover removed to illustrate a power source and a motor.

FIGS. 1-4 illustrate a hair cutting apparatus 10, illustrated as a hair trimmer. With specific reference to FIG. 1, the hair trimmer 10 includes a housing 14 that is defined by a lower (or bottom or first) housing 18 coupled to an upper (or top or second) housing 22. The housing 14 can be a clam shell configuration, with the lower and upper housings 18, 22 surrounding (or otherwise containing) one or more internal components. As shown in FIGS. 3-4, a plurality of fasteners 24 (shown as screws 24) can selectively connect the lower and upper housings 18, 22.

Referring to FIGS. 1 and 3, the housing 14 carries a user actuated power switch 26 (or toggle switch 26). The power switch 26 is provided to selectively facilitate operation of the hair trimmer 10. Stated another way, the power switch 26 allows a user to power the hair trimmer 10 "on" or "off". A blade assembly 30 is coupled to a blade assembly 200, while the blade assembly 200 is coupled to the housing 14. With reference to FIG. 2, the blade assembly 30 is mounted to the drive assembly 200 by a plurality of fasteners 34 (shown as screws 34).

As illustrated in FIG. 3, the power switch 26 is operatively connected to a power assembly 38 that is configured to selectively distribute power (e.g., electricity, etc.) to a motor assembly 42. The power assembly 38 includes an electrical switch 46, a controller 50, and a power source 54 (shown in FIG. 4). The electrical switch 46 is coupled to the power switch 26. This facilitates actuation of the electrical switch 46 in response to actuation of the power switch 26. The electrical switch 46 is also in electrical communication with a controller 50, illustrated as a printed circuit board (or PCB). The controller 50 can be coupled to the lower housing 18 by one or more fasteners 58 (illustrated as a plurality of screws 58).

The controller 50 is also in electrical communication with the power source 54. As illustrated in FIG. 4, the power source 54 is a battery, and more specifically a rechargeable battery. For example, the rechargeable battery 54 can be a lithium-ion (Li-ion), Nickel Cadmium (NiCd), Nickel-Metal Hydride (NiMH), or any other suitable type of rechargeable battery 54. In other embodiments, the power source 54 can be a conduit or other suitable electrical intermediary to transport electricity from an outlet (or other suitable source of electricity) to the motor assembly 42 (e.g., a cord, etc.).

Referring to FIGS. 3-4, the motor assembly 42 includes a motor cover 62 (shown in FIG. 3) that covers a motor 66 (shown in FIG. 4). As shown in FIG. 4, the motor 66 (or electric motor 66 or prime mover 66) is operatively connected to a drive assembly 200, while the drive assembly 200 is coupled to the blade assembly 30. A cover or shield 70 is connected to the upper housing 22 by a plurality of shield fasteners 74 (shown as screws 74). The shield 70 is positioned to partially overlap the drive assembly 200. Further, the shield 70 is proximate the blade assembly 30 to assist with limiting hair or other debris from interfering with operation of the drive assembly 200. In other embodiments, the shield 70 can be formed with (or attached to) the upper housing 22.

Figure 5:
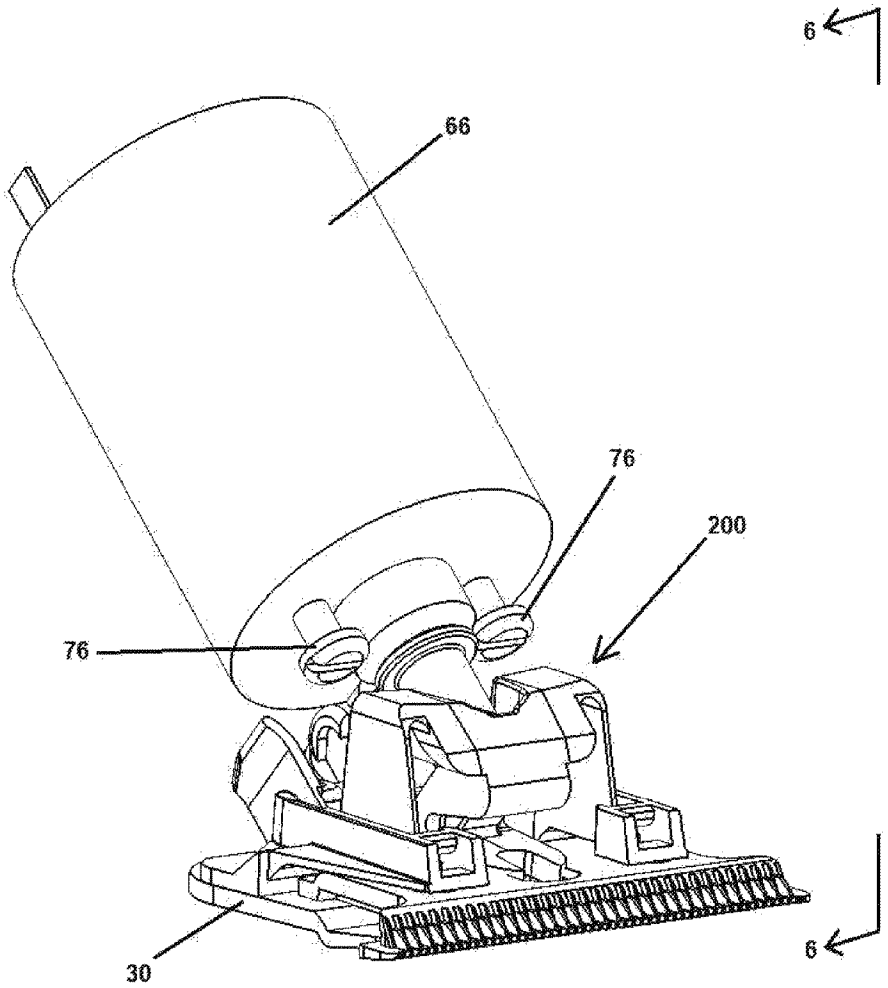
FIG. 5 is a perspective view of the hair cutting apparatus of FIG. 4 with a lower housing, a shield, and a power source removed to illustrate an operable connection between a motor, a drive assembly, and a blade assembly.
Figure 6:
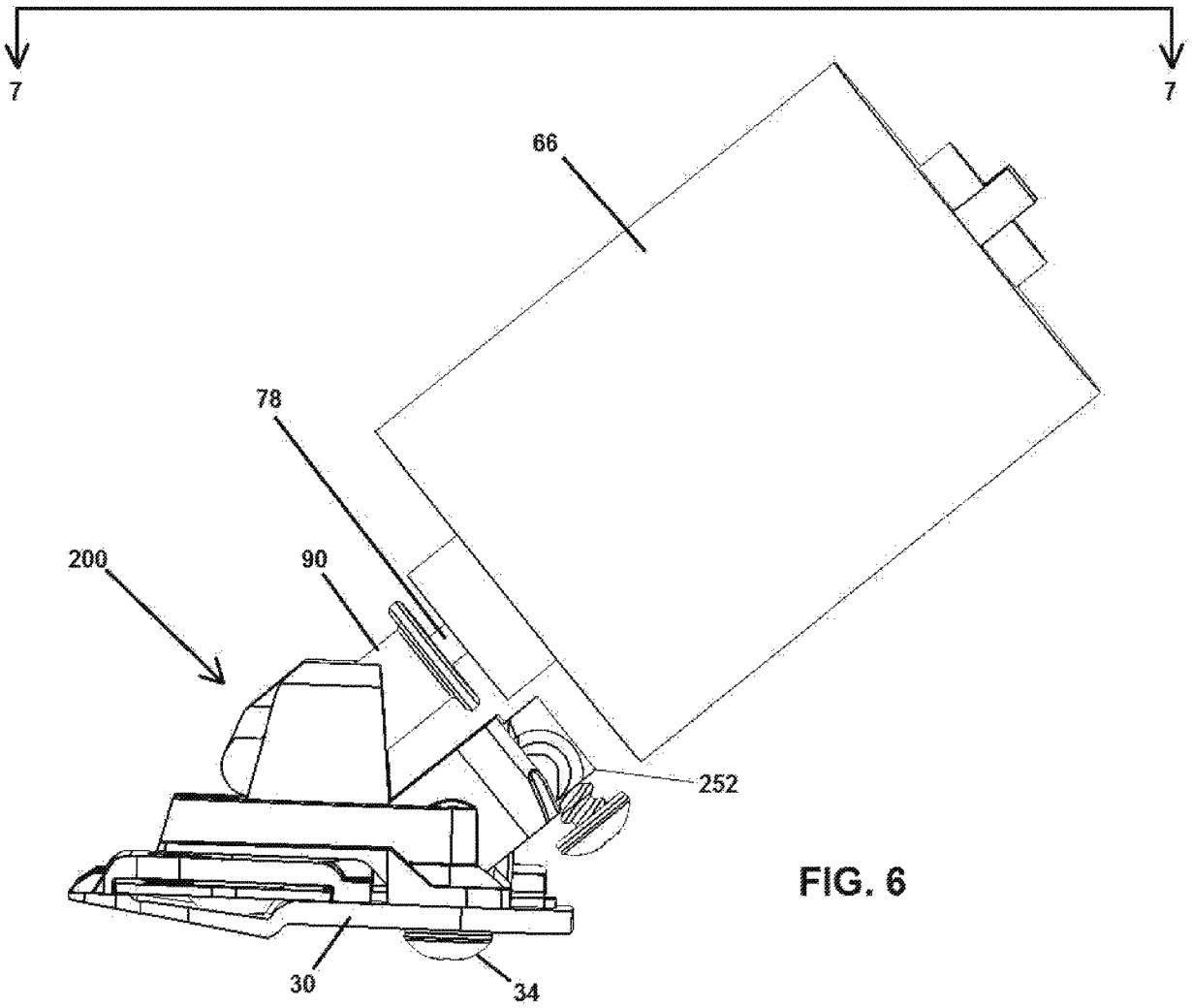
FIG. 6 is a side view of the operable connection between the motor, the drive assembly, and the blade assembly, taken along line 6-6 of FIG. 5.
Figure 7:
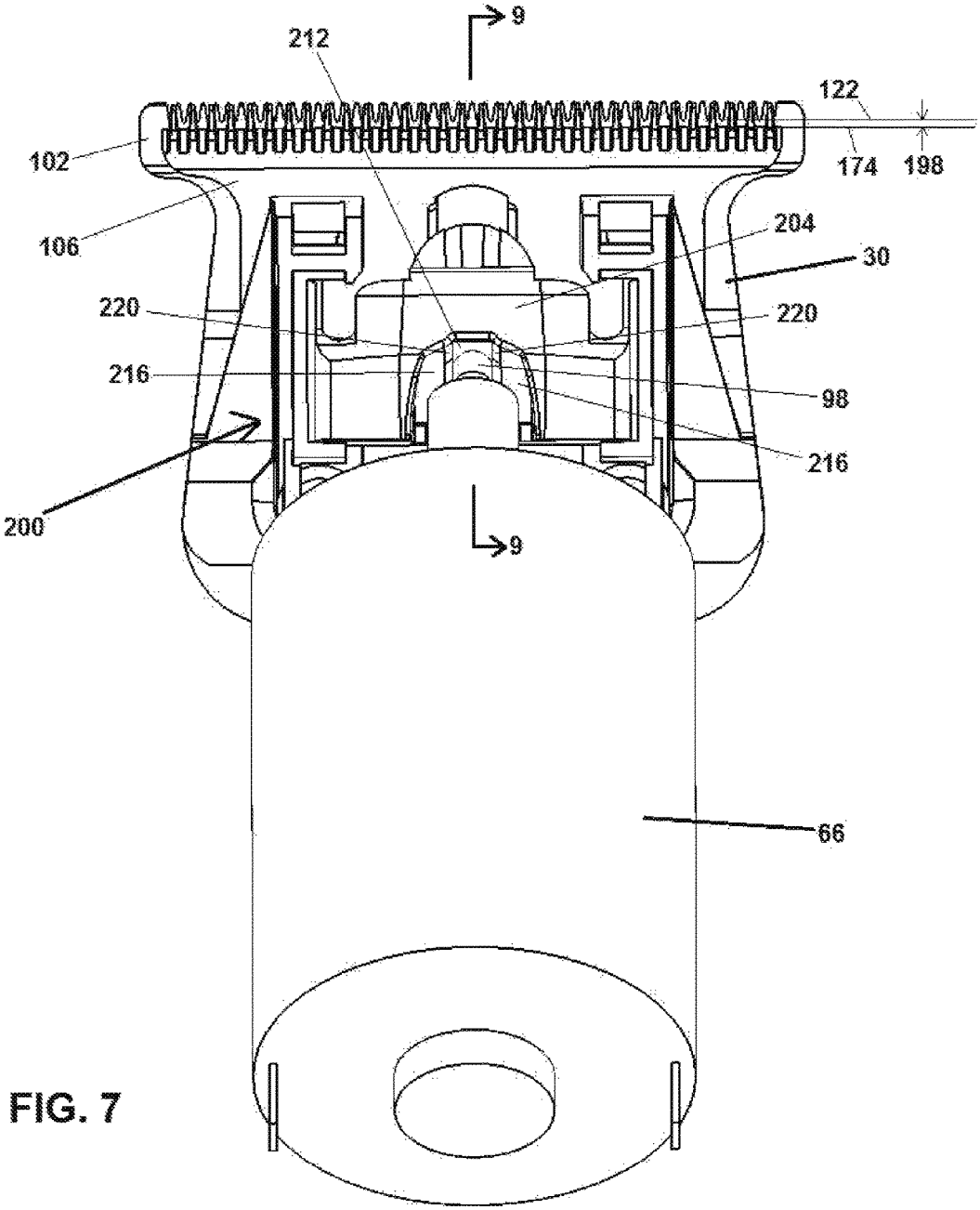
FIG. 7 is a top down view of the operable connection between the motor, the drive assembly, and the blade assembly, taken along line 7-7 of FIG. 6.

Referring now to FIGS. 5-7, the motor 66, the drive assembly 200, and the blade assembly 30 is illustrated separate from the other components of the hair cutting apparatus 10 (e.g., housing 14, etc.). The motor 66 is in operable engagement with (or operably engaged to) the drive assembly 200. The drive assembly 200 is in operable engagement with (or operably engaged to) the blade assembly 30. The operable engagement between components, which is discussed in additional detail below, facilitates a conversion of rotational motion generated by the motor 66 into translational (or lateral) motion of the blade assembly 30 sufficient to cut (or trim) hair. It should be appreciated that FIG. 5 illustrates a pair of motor mounting fasteners 76 (or screws 76). The motor mounting fasteners 76 can mount the motor 66 to the lower housing 18. For example, the lower housing 18 can include a cross member or other structural component that can be engaged by the motor mounting fasteners 76 to attach (or otherwise mount or couple) the motor 66 to the housing 14. In other embodiments, the motor 66 can be mounted to the upper housing 22 or a portion thereof.

Figure 8:
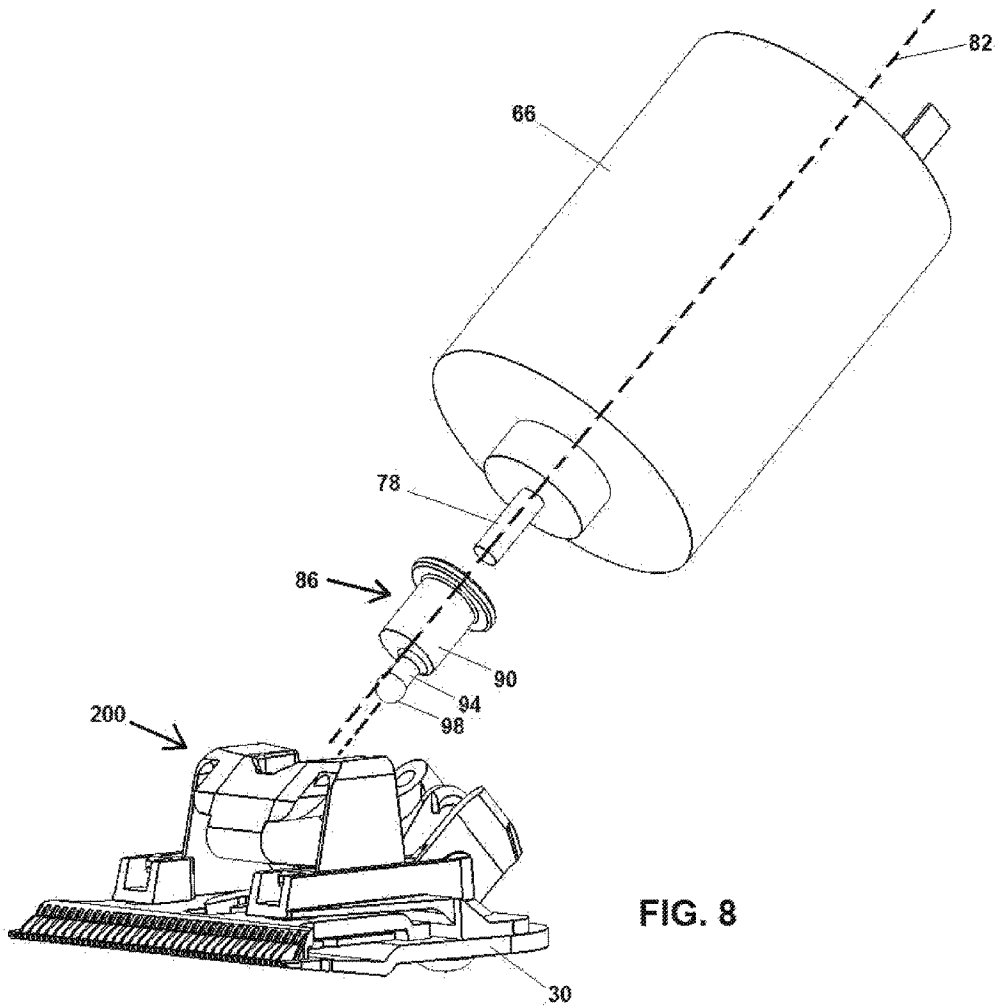
FIG. 8 is a perspective view of the motor, the drive assembly, and the blade assembly of FIG. 5, with the motor removed from the drive assembly, the motor shown in a partially exploded view.
Figure 9:
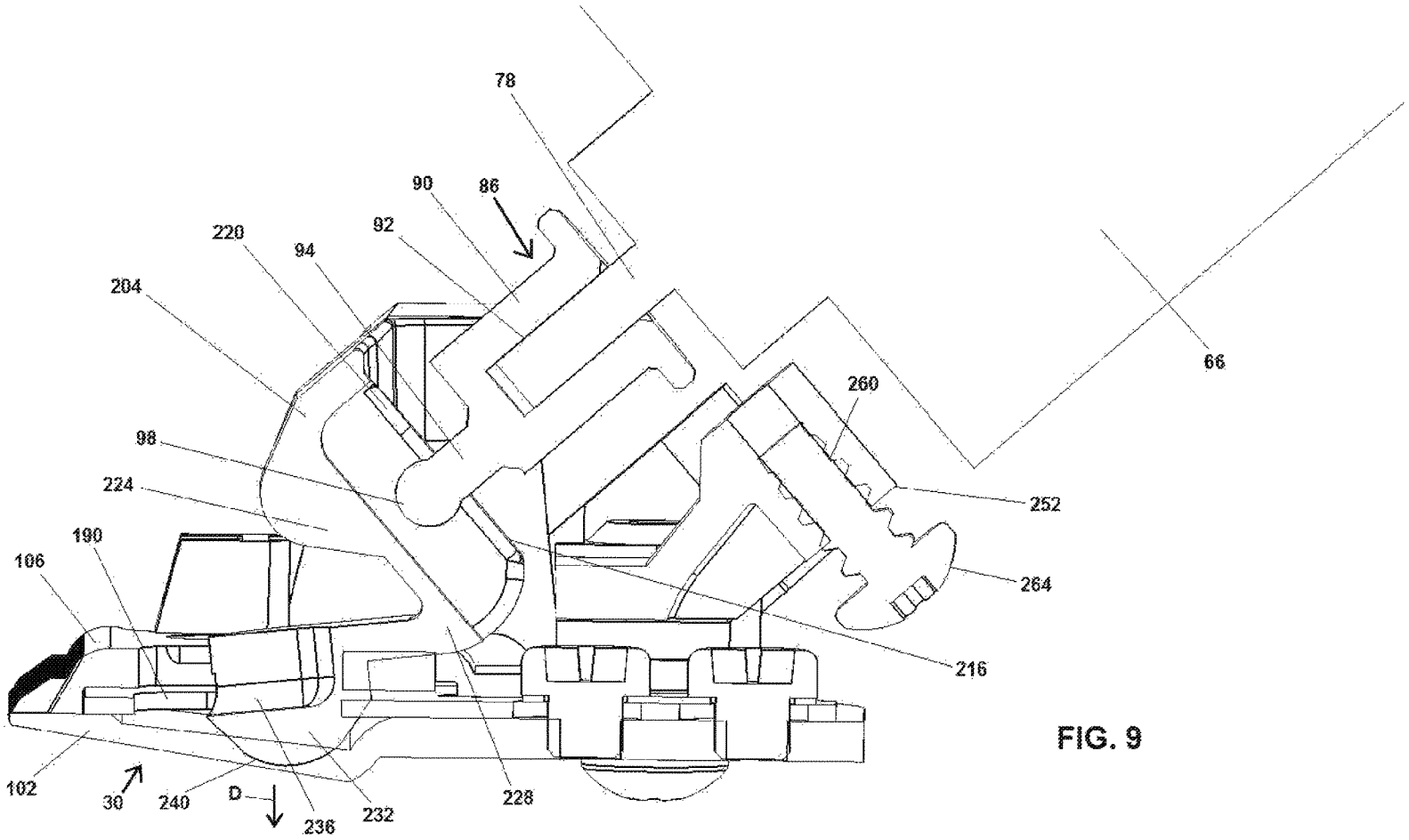
FIG. 9 is a cross-sectional view of the motor, the drive assembly, and the blade assembly of FIG. 5, taken along line 9-9 of FIG. 7.

As illustrated in FIG. 8-9, the motor 66 includes a drive shaft 78 that rotates around (or with respect to) an axis of rotation 82 (shown in FIG. 8). A drive mechanism 86 is mounted to the drive shaft 78. For example, the drive mechanism 86 can include an eccentric drive 90 that is coupled to the drive shaft 78. The eccentric drive 90 can include an internal channel 92 (shown in FIG. 9) that is configured to receive the drive shaft 78. The eccentric drive 90 includes a drive member 94 having a rounded head 98 (or a circular head 98, or arcuate head 98, or ball shaped head 98). The drive member 94 is offset from the axis of rotation 82 of the drive shaft 78. The drive mechanism 86 is configured to rotate as the drive shaft 78 rotates with respect to the axis of rotation 82.

Figure 10:
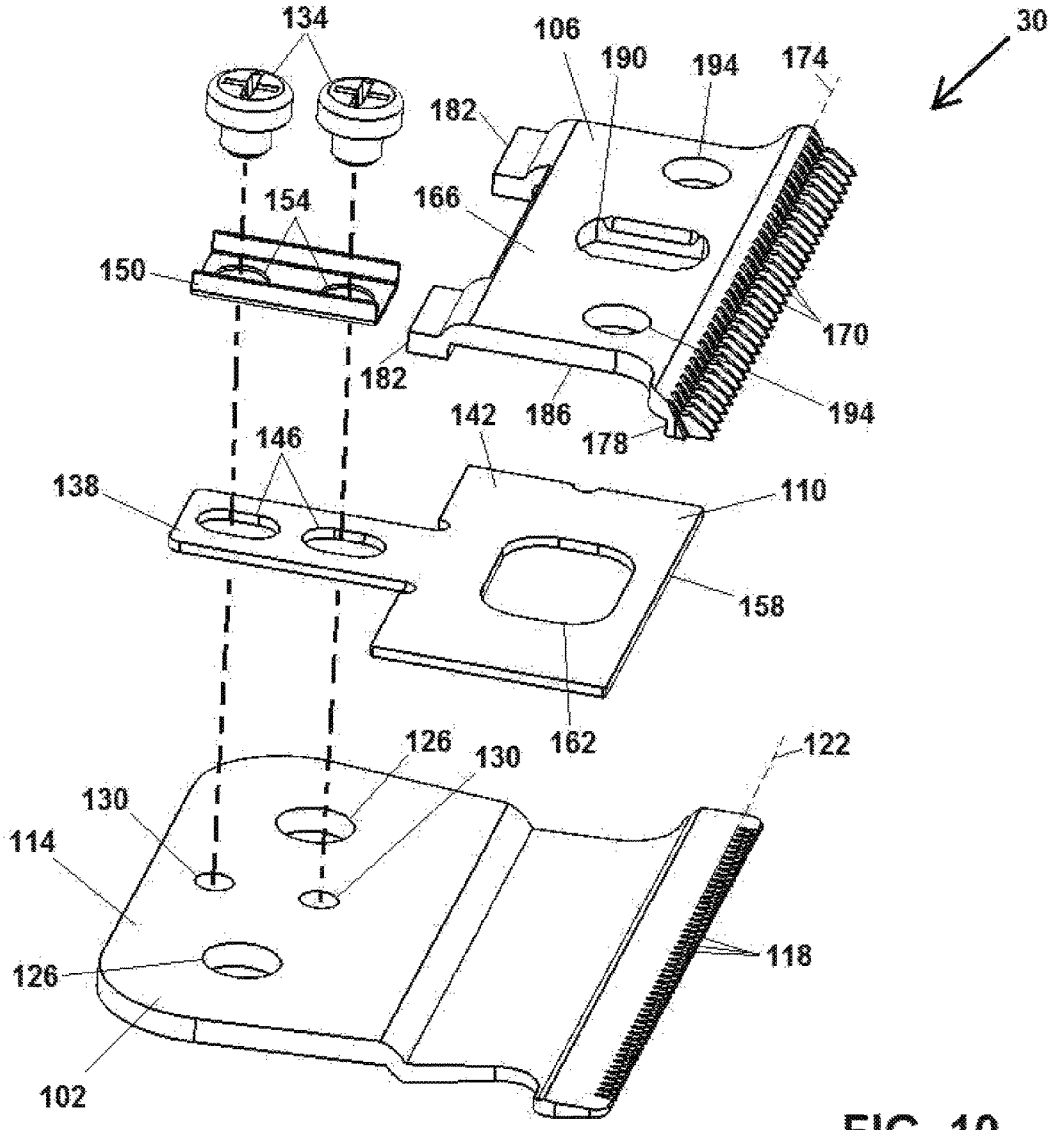
FIG. 10 is an exploded view of the blade assembly of FIG. 5.

FIG. 10 illustrates an exploded view of the blade assembly 30. The blade assembly 30 includes a lower blade 102 (or a first blade 102 or a second blade 102 or a stationary blade 102), an upper blade 106 (or a second blade 106 or a first blade 106 or a reciprocating or moving blade 106), and a guide 110 (or blade guide 110). The lower blade 102 includes a main body 114 (or lower blade body 114) and a plurality of lower blade teeth 118. The lower blade teeth 118 extend along a blade edge 122 (or lower blade edge 122). The blade edge 122 can be defined by a line 122 that connects the roots of the plurality of lower blade teeth 118. The main body 114 defines a plurality of blade mounting apertures 126. Each blade mounting aperture 126 is configured to receive one of the fasteners 34 to attach the blade assembly 30 (by the lower blade 102) to the drive assembly 200. The main body 114 also defines a plurality of guide mounting apertures 130. The guide mounting apertures 130 are preferably threaded holes, with each being configured to receive a respective guide fastener 134 (illustrated as a screw 134).

The blade guide 110 includes a guide base 138 and a cross portion 142. In the illustrated embodiment, the guide base 138 and cross portion 142 define a T-shaped blade guide 110. The guide base 138 defines a plurality of blade gap adjustment slots 146. Each slot 146 is elongated or oblong, and is configured to receive one of the guide fasteners 134. The guide fasteners 134 are further carried by a washer 150. The washer 150 defines a plurality of apertures 154, with each aperture respectfully receiving one of the guide fasteners 134. To couple the blade guide 110 to the lower blade 102, apertures 154, 146, 126 are aligned, with each guide fastener 134 being received by the aperture 154, the blade gap adjustment slot 146, and the threaded blade mounting aperture 126. The fastener 134 is then positioned into threaded engagement with the associated blade mounting aperture 126. The cross portion 142 includes a guide edge 158 that is positioned approximately parallel to the lower blade edge 122 (when the blade guide 110 is coupled to the lower blade 102). The cross portion 142 also defines a window 162 (or aperture 162) that extends through the cross portion 142. The blade guide 110 assists with adjusting a blade gap between the lower blade 102 and the upper blade 106, and further guides reciprocating movement of the upper blade 106.

The upper blade 106 includes a main body 166 (or an upper blade body 166) and a plurality of upper blade teeth 170. The upper blade teeth 170 extend along a blade edge 174 (or upper blade edge 174). The blade edge 174 can be defined by a line 174 that connects the roots of the plurality of upper blade teeth 170. A guide surface 178 is positioned approximately parallel to the blade edge 174, on an underside of the upper blade 106. The guide surface 178 is a channel (or depression) extending along a portion of the main body 166 to guide reciprocal movement of the upper blade 106. A pair of feet 182 depends from an end of the main body 166 that is opposite the upper blade teeth 170. The guide surface 178 and the feet 182 are offset from the main body 166 to define a guide recess 186. The guide recess 186 is configured to receive the blade guide 110, with the guide edge 158 being received by the guide surface 178 and the feet 178 positioned to straddle the guide base 138. The main body 166 also defines a central aperture 190 and a plurality of holes 194. The aperture 190 is configured to receive a biased portion of the drive assembly 200. More specifically, the drive assembly 200 biases the upper blade 106 into engagement with the lower blade 102 to maintain an operable connection between the blades 102, 106. In addition, the drive assembly 200 translates rotational motion from the motor 66 into reciprocal motion, allowing the upper blade 106 to reciprocate with respect to the lower blade 102 (e.g., the lower blade 102 is stationary with respect to the upper blade 106). The holes 194 can provide a connection point to further couple or otherwise provide an additional connection between the upper blade 106 and the drive assembly 200. For example, the drive assembly 200 can include a fastener, a finger, or other attachment member (not shown) that can be configured to be received by a corresponding hole 194.

The blade guide 110, which is sandwiched (or positioned) between the upper blade 106 and the lower blade 102, facilitates adjustment of a blade gap 198 (shown in FIG. 7).

The blade gap is an offset distance between the blade edges 122, 174, the offset distance being generally perpendicular to the blade edges 122, 174. The blade gap generally determines the length to which hair will be cut. Generally, the smaller the blade gap, the smaller the distance between the blade edges 122, 174, achieving a closer (or shorter length) cut of hair. Similarly, the larger the blade gap, the greater the distance between the blade edges 122, 174, and the less close (or less short) cut of hair.

To adjust the blade gap, the guide fasteners 134 are loosened from engagement with the guide mounting apertures 130. This frees the blade guide 110 to slide laterally, or generally perpendicular to the blade edges 122, 174. More specifically, the blade guide 110 can slide towards (or away from) the lower blade teeth 118. The sliding distance of the blade guide 110 is determined by the length of one (or both) of the blade gap adjustment slot(s) 146. Stated another way, the guide base 138 slides with respect to the guide fasteners 134 (and the lower blade 102), with the guide fasteners 134 sliding within each respective blade gap adjustment slot 146. As the blade guide 110 slides, it slides the upper blade 106, which is carried by the cross portion 142. Once the desired blade gap is established, each guide fastener 134 is tightened into engagement with the corresponding guide mounting aperture 130 to maintain (or otherwise hold) the desired blade gap.

Figure 11:
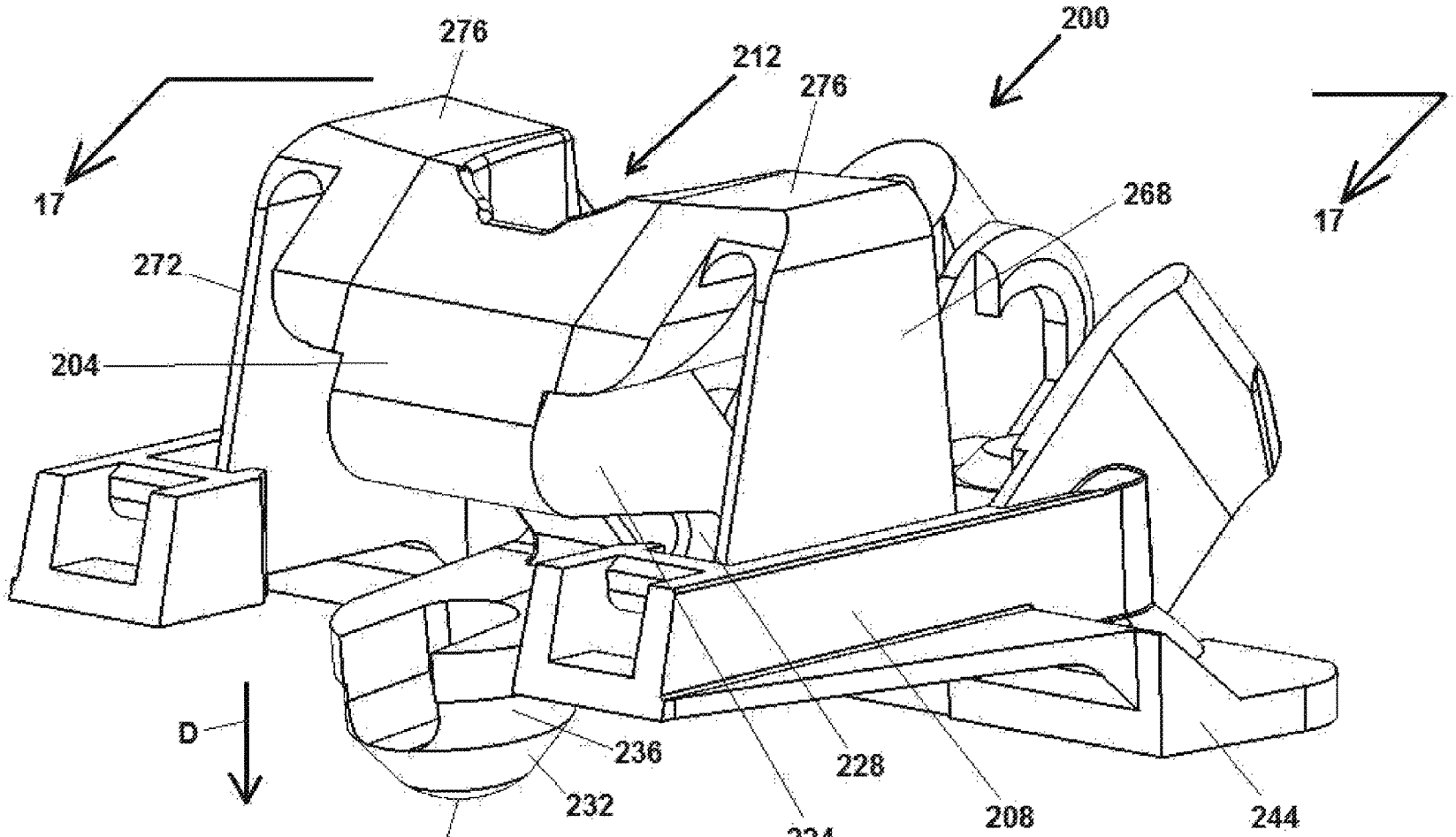
FIG. 11 is a perspective view of the drive assembly.
Figure 12:
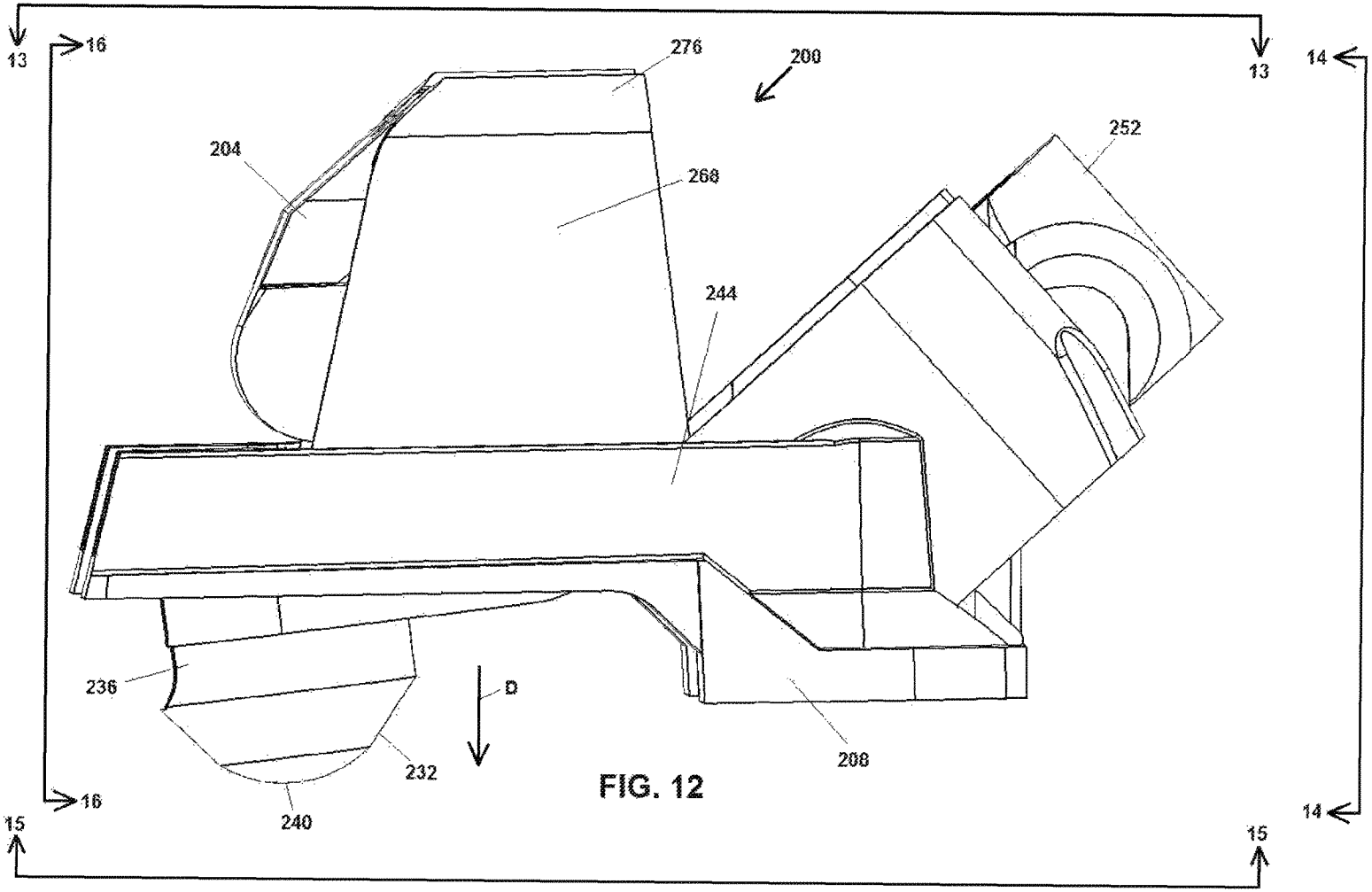
FIG. 12 is a first side view of the drive assembly of FIG. 11.
Figure 13:
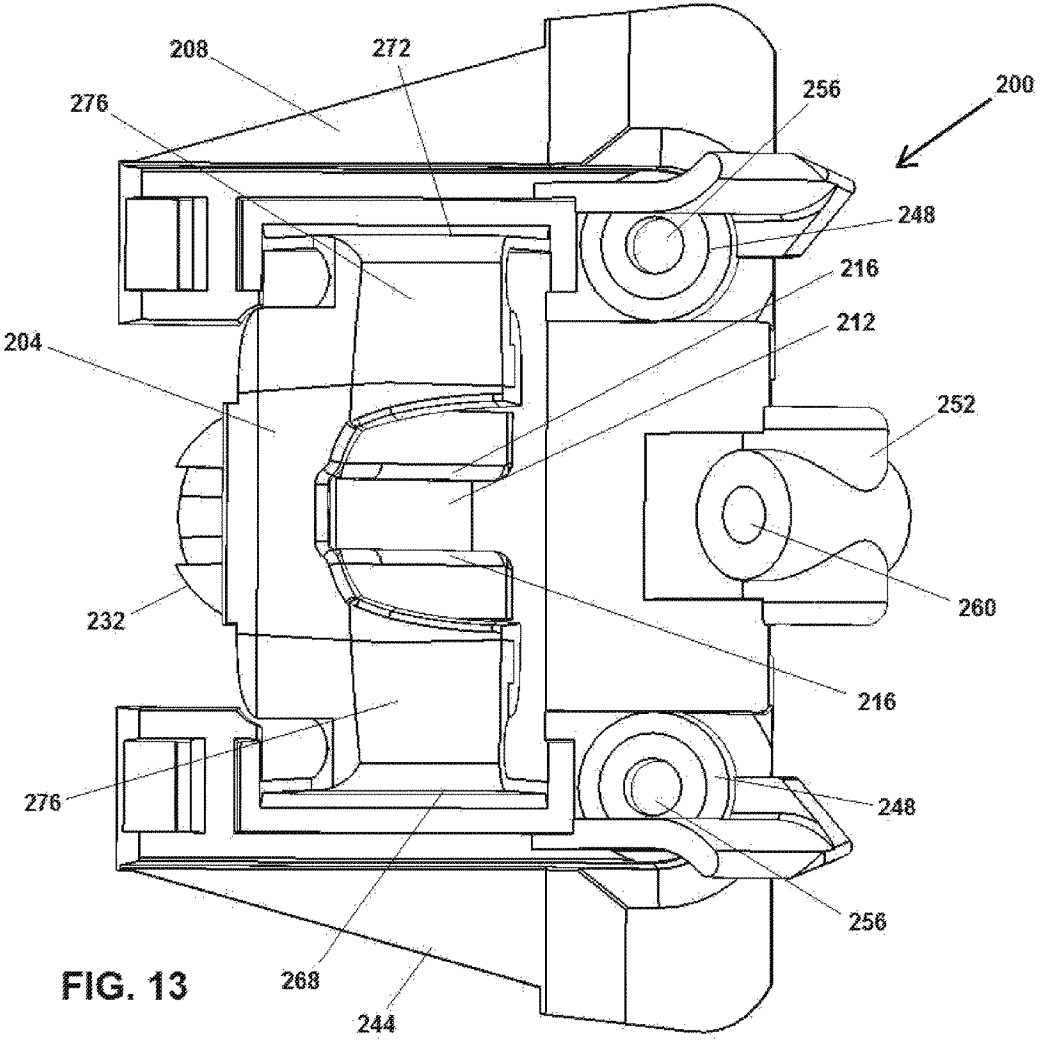
FIG. 13 is a top down view of the drive assembly of FIG. 11, taken along line 13-13 of FIG. 12.
Figure 14:
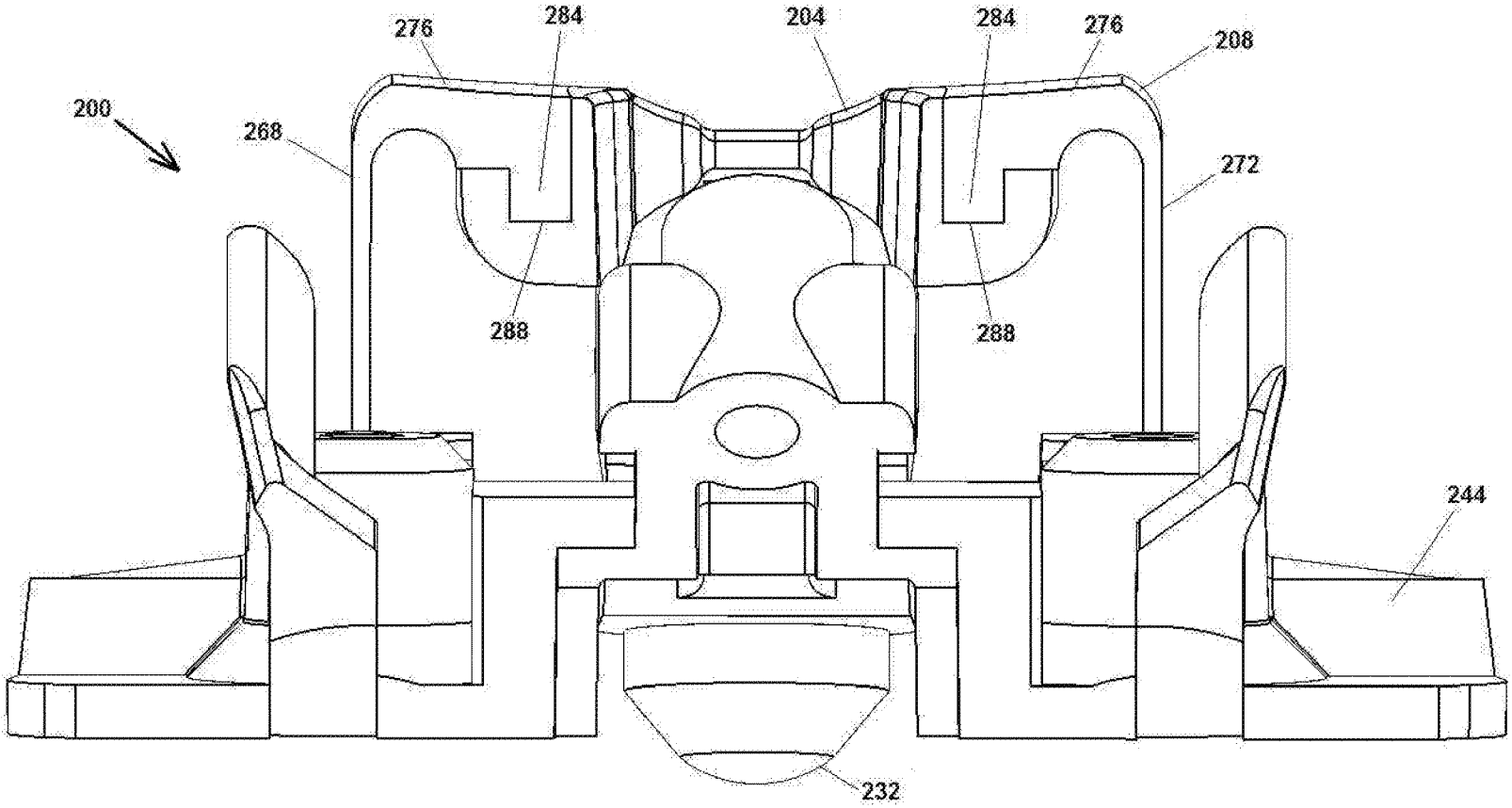
FIG. 14 is a back end view of the drive assembly of FIG. 11, taken along line 14-14 of FIG. 12.
Figure 15:
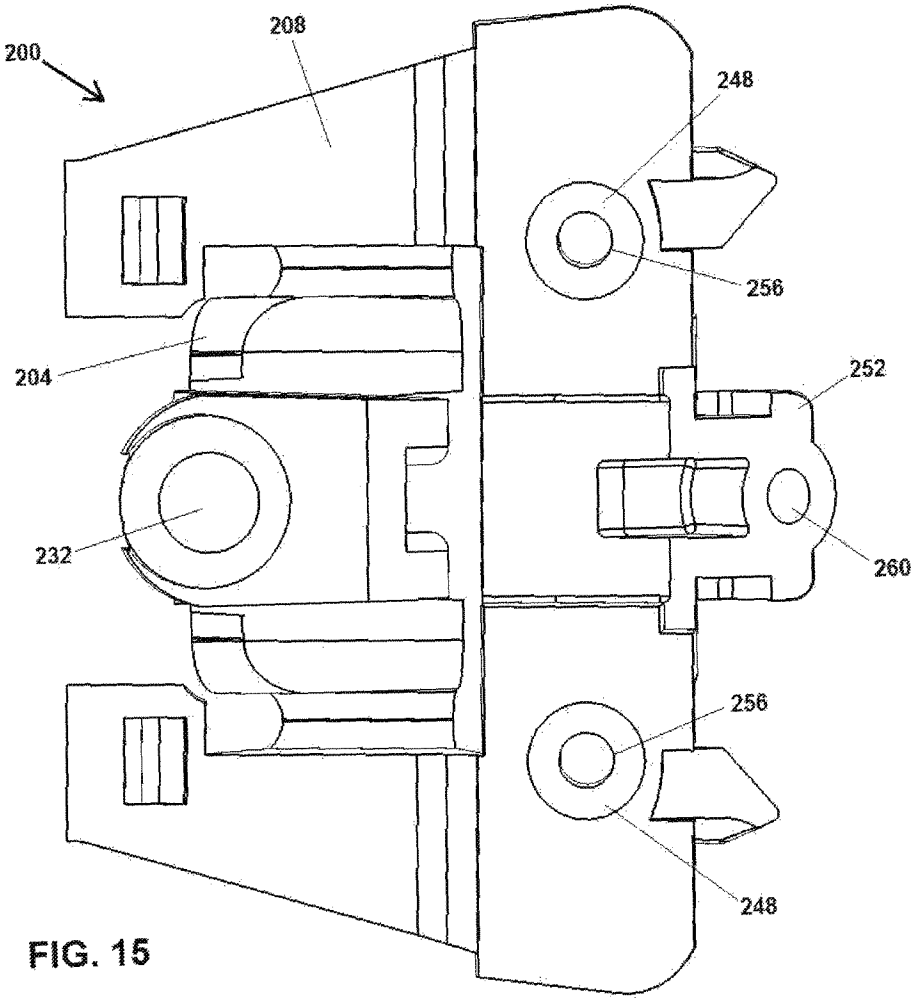
FIG. 15 is a bottom up view of the drive assembly of FIG. 11, taken along line 15-15 of FIG. 12.
Figure 16:
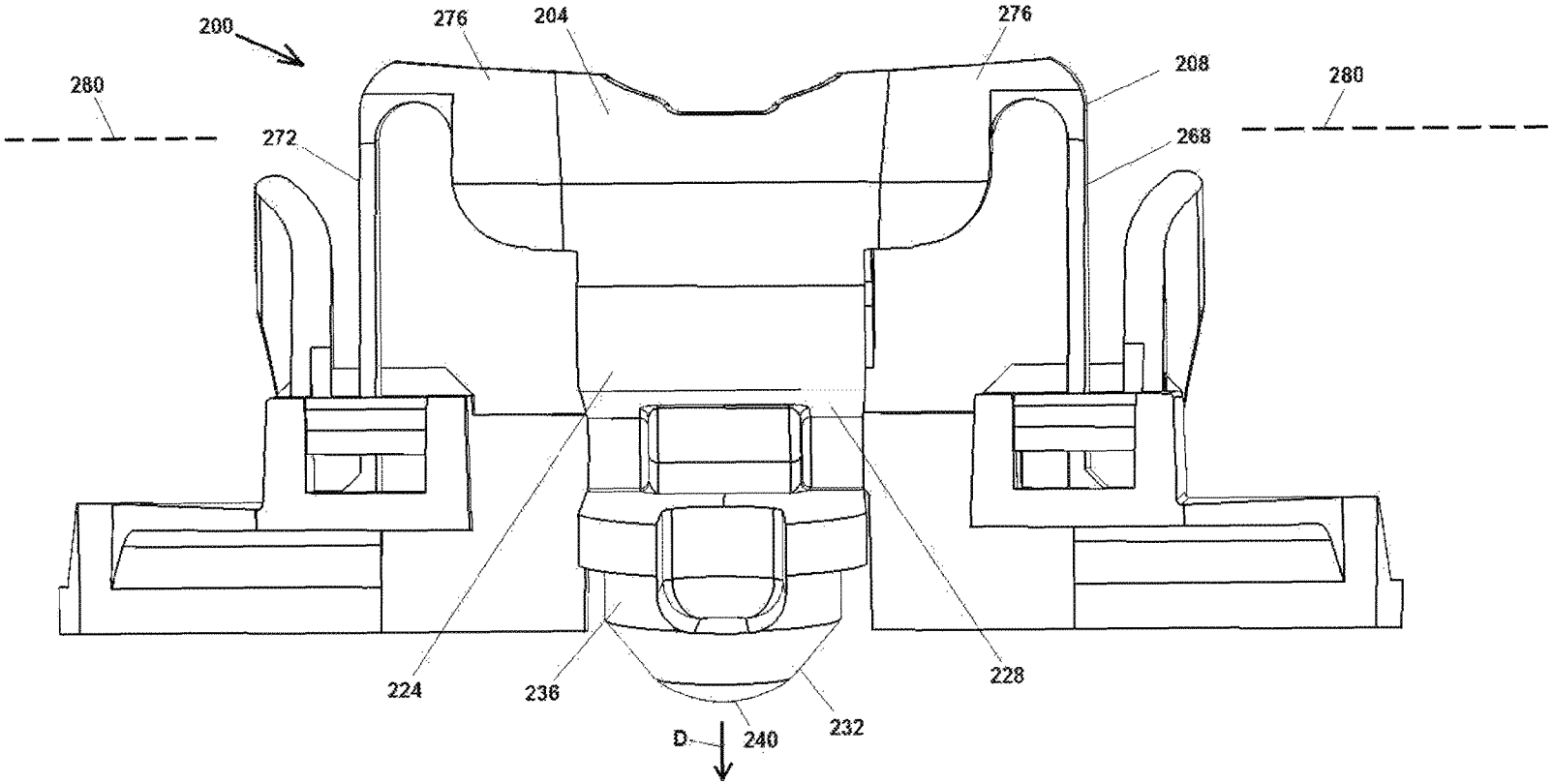
FIG. 16 is a front end view of the drive assembly of FIG. 11, taken along line 16-16 of FIG. 12.
Figure 17:
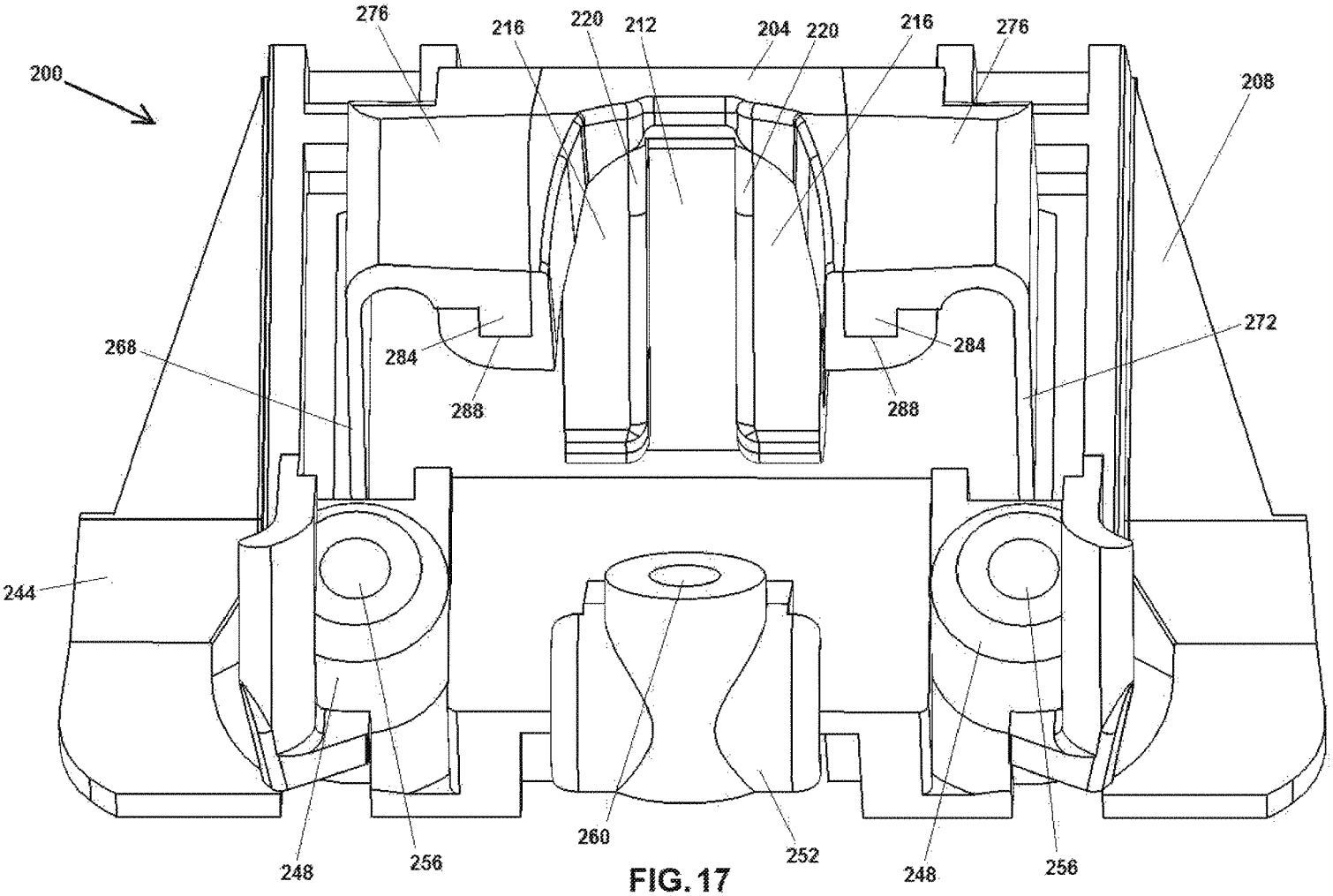
FIG. 17 is a perspective view of the drive assembly of FIG. 11, taken along line 17-17 of FIG. 11.

Referring now to FIGS. 11-17, the drive assembly 200 is illustrated. The drive assembly 200 includes a yoke assembly 204 (or yoke 204) and a support assembly 208 (or a hinge assembly 208 or a hinge 208 or a brace assembly 208). As best illustrated in FIGS. 13 and 17, the yoke 204 includes a slot 212 (or a channel 212) that is defined by opposing walls 216. The opposing walls 216 are generally parallel to each other, and can each include a curved or arcuate edge 220 along the sides of the slot 212. The slot 212 is configured to receive and retain the rounded head 98 of the drive member 94. The slot 212 can have a distance between the opposing walls 216 that is smaller (or narrower) than a diameter of the rounded head 98. The curved edges 220 can assist with insertion of the rounded head 98 into the slot 212 (see e.g., FIGS. 7 and 9). Further, the curved edges 220 can assist with retaining the rounded head 98 in the slot 212, while also minimizing wear on the drive member 94, the rounded head 98, and the yoke 204.

The yoke 204 also includes a tension arm 224. As illustrated in FIGS. 9, 11, and 16, the tension arm 224 has a curved (or arcuate) body 228, and a finger 232 (or member 232) positioned at an end of the body 228. The body 228 is illustrated as having a "C-shaped" cross-sectional shape (see FIG. 9). However, in other embodiments, the body 228 can have an "S-shaped" cross-sectional shape or any other suitable cross-sectional shape. The body 228 is biased in a direction D (shown in FIGS. 9, 12, and 16) to bias the finger 232 into engagement with the blade assembly 30 (shown in FIG. 9). Stated another way, the tension arm 224 biases the finger 232 towards the upper blade 106, into engagement with the upper blade 106. In addition, the finger 232 can engage the upper blade 106.

As shown in FIGS. 11, 12, and 16, the finger 232 can include a groove 236 (or channel 236 or depression 236). The groove 236 can extend around a portion of the finger 232, for example around a portion of a circumference of the finger 232. In the illustrated embodiment, the groove 236 is an annular groove 236. However, in other embodiments, the groove 236 can take any suitable shape, and can extend around a portion, up to and including the entirety, of the finger 232. The groove 236 is configured to engage the aperture 190 of the upper blade 106. This in turn, attaches (or otherwise engages) the tension arm 224, and more specifically the body 228 and/or the finger 232, to the upper blade 106. With reference to FIG. 9, the finger 232 is received by the aperture 190 in the upper blade 106. A portion of an edge or wall or a perimeter that defines the aperture 190 (e.g., a portion of the main body 166) can be received by the groove 236, attaching the upper blade 106 to the yoke 204, and more specifically attaching the upper blade 106 to the tension arm 224.

Referring to FIGS. 9 and 12, the finger 232 can include a curved tip 240 (or actuate tip 240). The curved tip 240 is configured to contact the lower blade 102, and more specifically the main body 114 of the lower blade 102, in response to the yoke 204 engaging the blade assembly 30. The curved tip 240 reduces friction and wear on the tension arm 224 during operation of the drive assembly 200, which is discussed in additional detail below.

Referring generally back to FIGS. 11-17, the support assembly 208 includes a body 244 that defines a blade assembly mounting structure 248 (shown in FIGS. 13, 15, and 17) and a housing mounting structure 252 (also shown in FIGS. 13, 15, and 17). The blade assembly mounting structure 248 includes a plurality of apertures 256 (or holes 256) that are each respectively configured to receive one of the fasteners 34, fastening the blade assembly 30 to the drive assembly 200. The housing mounting structure 252 includes an aperture 260 (or hole 260) that is configured to receive a fastener 264 (or screw 264), shown in FIGS. 6 and 9. The fastener 264 fastens the drive assembly 200 to the housing 14, and more specifically to the lower housing 18.

The support assembly 208 also includes a plurality of arms 268, 272 that connect the body 244 to the yoke 204. As illustrated in FIGS. 11-14 and 16-17, a first arm 268 is spaced from a second arm 272. The first and second arms 268, 272 act as a living hinge (or hinges) to provide and support reciprocating movement of the yoke 204. The arms 268, 272 each include a cross-bar 276 (or a cross-member 276) to facilitate a connection to the yoke 204. The cross-bar 276 can be approximately orthogonal or perpendicular to the arms 268, 272, with the yoke 204 positioned between the arms 268, 272. The arms 268, 272 are configured to pivot (or slide or reciprocate) side-to-side along axis 280 (shown in FIG. 16), which is approximately perpendicular (or orthogonal) to the arms 268, 272. The cross-bar 276 can also provide structural support for the yoke 204. With specific reference to FIGS. 14 and 17, the cross-bar 276 can include a projection 284 (or member 284) that is configured to be received by a corresponding slot 288 (or channel 288) in the yoke 204 during formation of the drive assembly 200. In the illustrated embodiment, the projection 284 is an elongated projection, while the slot 288 is a corresponding elongated slot. The slot 288 advantageously provides additional surface area to facilitate formation of a chemical bond between the material that forms the slot 288 and the material that forms the projection 284. The chemical bond between the materials improves material adhesion between the projection 284 and the slot 288, while the mechanical bond formed by the slot 288 receiving the corresponding projection 284 improves torsion resistance (or increases twisting resistance from an applied torque). The improved material adhesion and torque improves (or reduces) wear and increases an operational life of the drive assembly 200. It should be appreciated that the projection 284 and the slot 288 can include any suitable complimentary geometry to facilitate a connection. It should also be appreciated that while the illustrated embodiment discloses a plurality of arms as two arms 268, 272, in other embodiments, more than two arms can be utilized to support reciprocating movement of the yoke 204. In addition, it should be appreciated that while the yoke 204 is illustrated with the elongated slot 288, in other embodiments the yoke 204 can carry the projection 284 that engages an elongated slot 288 on the cross-bar 276.

The drive assembly 200 is integrally formed as a single piece (or a unitary structure) that is formed of multiple materials (or a plurality of materials). The yoke 204 is formed of a first material, while the support assembly 208 is formed of a second material that is different than the first material. Material selection for the support assembly 208 and the yoke 204 involves selecting materials that have good flexibility and fatigue resistance for the support assembly 208, and relatively high strength and rigidity for the yoke 204. At the same time, the materials should have a substantially similar melting point so they can be molded in the same die at the same mold temperature. In the illustrated embodiment, the yoke 204 can be formed of a glass filled polypropylene, while the support assembly 208 can be formed of a polypropylene. Polypropylene and glass-filled polypropylene are made from the same, or a very similar, resin, and have a similar melting temperature (approximately 450° F.). Glass-filled polypropylene generally has a greater stiffness (or is stiffer) than polypropylene. Thus, the yoke 204, which biases the upper blade 106 into engagement with the lower blade 102 and supports reciprocating motion of the upper blade 106 with respect to the lower blade 102, generally has a greater stiffness than the support assembly 208, which transfers rotational motion from the motor 66 to side-to-side reciprocating motion. While the drive assembly 200 is disclosed as being formed by polypropylene and glass-filled polypropylene, it should be appreciated that any suitable material or combination of materials can be used to form the drive assembly 200. The drive assembly 200 can be formed by a multi-step process, such as multi-step injection molding (e.g., a two-shot injection molding, etc.) in a common mold. For example, one of the yoke assembly 204 or the support assembly 208 can be formed at a moment in time separate from the other of the support assembly 208 or the yoke assembly 204. The mold can have a mold temperature of approximately 130° F.

As assembled, the motor 66 is coupled to the drive assembly 200 (e.g., the rounded head 98 is received by the slot 212), and the drive assembly 200 is coupled to the blade assembly 30 (e.g., the yoke 204 is coupled to the upper blade 106). In operation, the motor 66 rotates the drive shaft 78, which rotates the drive mechanism 86, and more specifically the eccentric drive 90. As the eccentric drive 90 rotates, the drive member 94 and rounded head 98 rotate with respect to the axis of rotation 82 of the motor 66. With the rounded head 98 received by the slot 212 in the yoke, as the eccentric drive 90 rotates, the yoke 204 moves (or pivots) from side to side. The side to side, straight line motion along axis 280 (shown in FIG. 16) is supported by the arms 268, 272, and translated to the tension arm 224 and associated finger 232. Since the finger carries the upper blade 106, the side to side motion of the finger 232 is translated to the upper blade 106. Thus, the upper blade 106 reciprocates with respect to the blade guide 110, and further with respect to the lower blade 102. The biased tension arm 224 also maintains an operable connection between the upper and lower blades 106, 102, maintaining the blades 106, 102 in a cutting (or trimming) configuration. The curved tip 240 is received through the window 162 of the blade guide 110, and slides along a portion of the main body 114 of the lower blade 102. The curved tip 240 reduces a surface area or point contact between the finger 232 and the blade assembly 30 (or lower blade 102), which reduces friction between the finger 232 and the blade assembly 30, and further improve wear of the finger 232.

The drive assembly 200 disclosed herein has certain advantages. For example, the drive assembly 200 is a single, unitary construction that applies tension between the upper and lower blades 106, 102 (e.g., through the biased tension arm 224) and transfers rotational motion to reciprocating motion. Known drives utilize multiple components, and often include a separate, metal tension spring to apply tension between the blades 102, 106. The drive assembly 200 disclosed herein eliminates the need for a separate spring, since the tension arm 224 is biased (or "spring loaded") to apply a biasing force to compress the upper blade 106 (or moving or active blade 106) towards the lower blade 102 (or static or non-moving blade 102).

In addition, by implementing a rounded head 98 on the eccentric drive 90 that engages with the yoke 204, the motor 66 has point contact with the yoke 204. This reduces wear (or improves wear) on the drive assembly 200 and the eccentric drive 90.

Further, the geometry of the yoke 204 and the support assembly 208 utilizes a straight line mechanism principle. Rotational movement generated by the motor 66 is more efficiently transferred to side-to-side or reciprocating movement of the blade assembly 30, and more specifically the upper blade 106. Since the yoke 204 is positioned between the support arms 268, 272, and the side to side movement of the yoke 204 causes the arms 268, 272 to move side to side along a straight line (i.e., along axis 280), rotational movement is more efficiently transferred to reciprocating or side-to-side movement. In addition, wear on the arms 268, 272 and related components are reduced, improving operational life of the drive assembly 200.

Various additional features and advantages of the invention are set forth in the following claims.

What is claimed is:

1. A hair grooming device comprising:

a yoke assembly that includes a slot that is configured to receive an eccentric drive, and a biased tension arm having a finger at one end, the finger includes a groove, the tension arm configured to engage a blade assembly;

a support assembly coupled to the yoke assembly, the support assembly includes a first arm spaced apart from a second arm, the first and second arms being respectively coupled to the yoke assembly, the yoke assembly being positioned between the first and second arms, wherein the blade assembly includes a first blade and a second blade, the first blade is configured to reciprocate with respect to the second blade, the tension arm is biased into engagement with the first blade, and the groove is configured to receive a portion of the first blade.

2. The hair grooming device of claim 1, wherein the yoke assembly and the support assembly are formed as a unitary structure.

3. The hair grooming device of claim 1, wherein the yoke assembly is formed of a first material, and the support assembly is formed of a second material that is different from the first material.

4. The hair grooming device of claim 3, wherein the first material is glass filled polypropylene.

5. The hair grooming device of claim 4, wherein the second material is polypropylene.

6. The hair grooming device of claim 3, wherein the first material has a greater stiffness than the second material.

7. The hair grooming device of claim 1, wherein the first blade defines an aperture, the aperture receives the finger, and a portion of a perimeter of the aperture is received by the groove.

8. The hair grooming device of claim 1, wherein the finger includes an arcuate tip.

9. The hair grooming device of claim 1, wherein the finger includes a curved tip.

10. The hair grooming device of claim 1, wherein the eccentric drive includes a rounded head that engages the slot.

11. The hair grooming device of claim 10, wherein the rounded head is received by the slot.

12. The hair grooming device of claim 1, wherein the first and second arms reciprocate along an axis in response to rotational movement of the eccentric drive, the axis being perpendicular to the first and second arms.

13. The hair grooming device of claim 1, wherein the support assembly includes one of a projection or a slot, and the yoke assembly includes the other of the slot or the projection, the slot and the projection mate to connect the yoke assembly and the support assembly as a unitary structure.

14. The hair grooming device of claim 1, further comprising a cross-member that connects the first arm and the second arm to the yoke assembly.

15. The hair grooming device of claim 1, wherein the tension arm has a C-shaped cross-sectional shape.

* * * * *